US007331881B2

(12) United States Patent
Smith

(10) Patent No.: US 7,331,881 B2
(45) Date of Patent: Feb. 19, 2008

(54) PORTABLE FENCE-MOUNTABLE BASKETBALL GOAL AND METHOD

(76) Inventor: Robert Smith, Maldive Rd., Anse Etoile, poste restante, Mahe (SC)

( * ) Notice: Subject to any disclaimer, the term of this patent is extended or adjusted under 35 U.S.C. 154(b) by 225 days.

(21) Appl. No.: 11/013,864

(22) Filed: Dec. 16, 2004

(65) Prior Publication Data

US 2005/0137036 A1 Jun. 23, 2005

Related U.S. Application Data

(60) Provisional application No. 60/530,401, filed on Dec. 17, 2003.

(51) Int. Cl.
*A63B 63/08* (2006.01)

(52) U.S. Cl. ..... 473/481; D21/701

(58) Field of Classification Search ..... 473/481, 473/479, 476, 483, 485, 429; D20/41; 40/604; 16/259–262

See application file for complete search history.

(56) References Cited

U.S. PATENT DOCUMENTS 212,035 A * 2/1879 Miller ..... 54/62
633,765 A * 9/1899 Lowe ..... 54/62
2,512,417 A 6/1950 Cook
2,517,463 A * 8/1950 Cobb ..... 473/481
3,237,978 A * 3/1966 Swanson ..... 292/113
3,414,262 A 12/1968 Lounsbury
3,904,199 A * 9/1975 Burchett ..... 473/461
4,036,494 A * 7/1977 Hayes ..... 473/481
4,183,522 A * 1/1980 Killen ..... 473/483
4,193,495 A 3/1980 Keeley
4,653,646 A 3/1987 Allen
4,974,841 A 12/1990 Jarriel et al.
5,207,407 A 5/1993 Fitzsimmons
5,271,649 A * 12/1993 Gromotka ..... 292/113
5,292,118 A 3/1994 Allen
5,386,986 A * 2/1995 Gamboa ..... 473/430
5,415,393 A 5/1995 Fitzsimmons
D377,141 S * 1/1997 Ford et al. ..... D8/331
5,624,113 A * 4/1997 Rabine ..... 473/430
5,626,244 A 5/1997 Mesna et al.
5,813,929 A * 9/1998 Tobin ..... 473/485
5,823,360 A 10/1998 Gorosave
5,827,136 A 10/1998 Halter et al.

(Continued)

OTHER PUBLICATIONS

Little Stars Do Magic, in The People, Feb. 18, 2000 (believed published in the Seychelles Islands), p. 15; attached as Exhibit B1 to the Statement Of Disclosure.

(Continued)

*Primary Examiner*—Eugene Kim
*Assistant Examiner*—M. Chambers
(74) *Attorney, Agent, or Firm*—Bradley, Arant, Rose & White LLP

(57) ABSTRACT

The present invention is a device and method variously and separately provided for a transportable backboard and hoop connectable to a chain-link fence as its support structure. Methods of teaching are included. Detail is also provided regarding the methods and structures for attachment of the device to the support structure. The invention is to be limited only by the scope of the claims as ultimately allowed in this application, and in no way limited by the prior versions of the claims inserted into this provisional application which are inserted only for purposes of priority and satisfaction of potential foreign filing requirements.

3 Claims, 9 Drawing Sheets

U.S. PATENT DOCUMENTS

| | | | | |
|---|---|---|---|---|
| 5,902,197 | A | | 5/1999 | Davis |
| 5,910,058 | A | | 6/1999 | Zheng |
| 5,980,401 | A | * | 11/1999 | Erlewine ..... 473/481 |
| 5,983,602 | A | | 11/1999 | Allen |
| 6,029,830 | A | | 2/2000 | Manookian |
| 6,053,825 | A | | 4/2000 | Allen |
| 6,749,074 | B1 | | 6/2004 | Hileman et al. |
| D493,056 | S | | 7/2004 | Shornak |
| 2003/0062328 | A1 | | 4/2003 | Millard |

OTHER PUBLICATIONS

FIBA Assist, FIBA's bi-monthly newsletter, Feb./Mar. 2001 edition; attached as Exhibit B2 to the Statement Of Disclosure.

"Seychelles' 'Baby Basketball' Programme Features in FIBA Assist"; Seychelles Nation Newspaper; Apr. 19, 2001; vol. XXIV, No. 76; attached as Exhibit B3 to the Statement.

Webpage print circa Mar. 2001; www.huffysports.co.uk/sidebarhomepage.html; attached as Exhibit C to the Statement Of Disclosure.

* cited by examiner

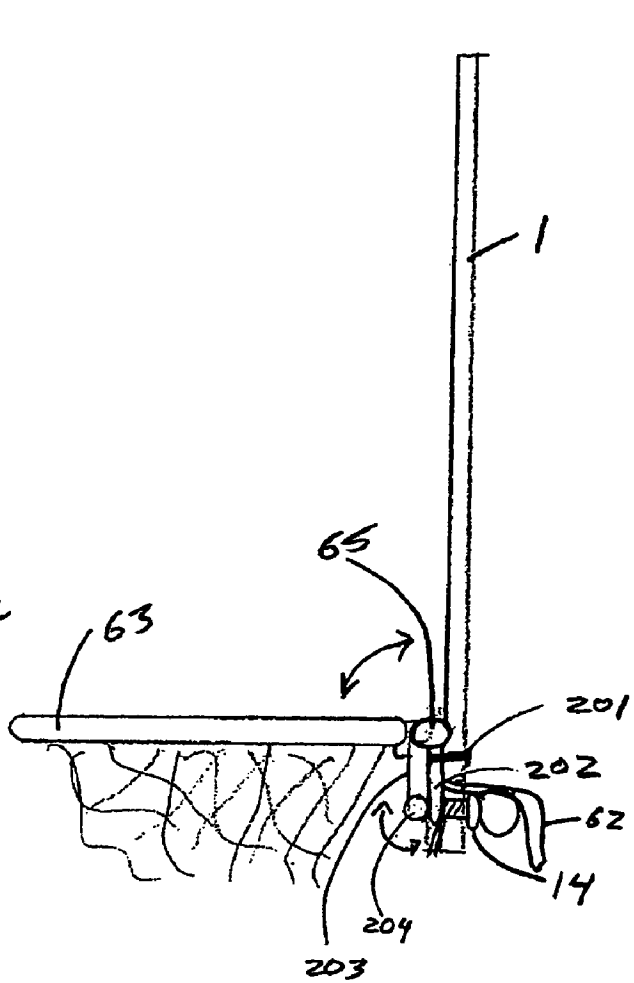
9A
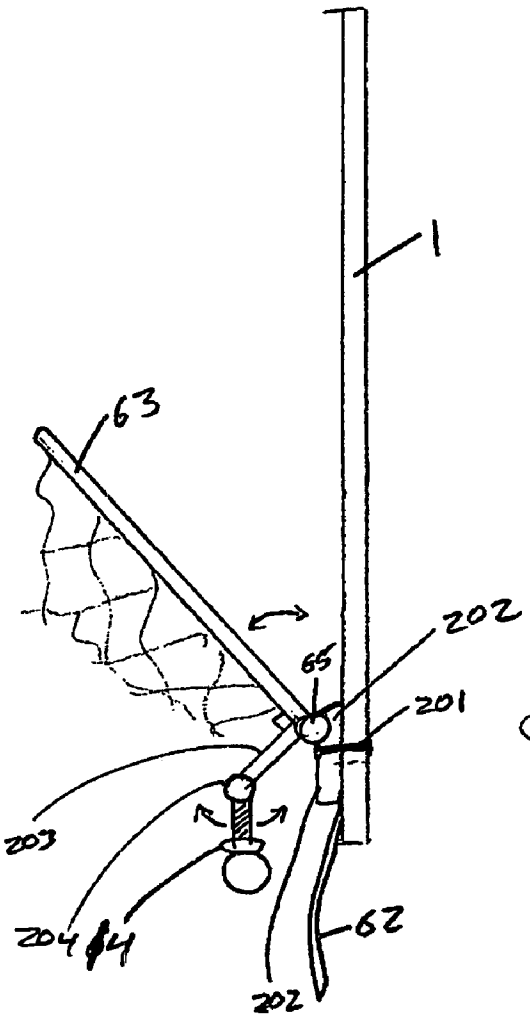
9B

PORTABLE FENCE-MOUNTABLE BASKETBALL GOAL AND METHOD

This application claims the benefit of and priority to U.S. Provisional Application 60/530,401 filed Dec. 17, 2003.

BACKGROUND OF THE INVENTION

1. Field of the Invention

This invention relates generally to an apparatus and method for a portable basketball goal and the attachment and removal of such a goal. More particularly, but without limitation, the invention is directed in one of its embodiments toward a latch system for repositionably attaching a portable basketball goal to a chain-link fence. Additionally, the invention relates to a method for teaching children and persons of short stature basketball techniques and skills.

2. Description of Related Art

In the art it is known that portable basketball goals are useful to allow the creation of a basketball court on an ad hoc basis. Heretofore, solutions aimed at providing a portable basketball goal assembly have been relatively large, being constructed complete with base, support pole, backboard, and hoop. These prior art solutions are rarely portable in the full sense of the term, being cumbersome and bulky to move. Accordingly, in practice, such devices are rarely and only inconveniently transported from one location to another, except perhaps from a storage room or closely adjacent locations on a single lot. None of these prior art solutions allow for a system that is easily transported by a single individual, or that can be readily transported in the trunk of a compact automobile.

BRIEF SUMMARY OF THE INVENTION

The present invention is limited only by the scope of the claims as ultimately allowed in this application, and in no way limited by the prior versions of the claims inserted into this provisional application which are inserted only for purposes of priority and satisfaction of potential foreign filing requirements. This specification discloses an apparatus and method for a portable and repositionable basketball goal. The apparatus is rendered imminently transportable in that it is attachable to any standard chain link fence. The need for a dedicated pole and support base, constructed specifically for the goal, is avoided. The device may be removed, folded down, and transported by a person on foot with little effort. Similarly, its compact design renders the device capable of being carried in sets of multiple goals by a single coach. Thus, an entire training camp can be transported and erected by a single individual with little inconvenience. This will have obvious advantages in locations where security, storage, theft, or space allocations are issues.

The invention further discloses a latch system for repositionably securing the goal against a fence. The latch system renders a secure attachment to the fence that will resist accidental dislodge or loosening of the connection.

OBJECTS OF THE INVENTION

The following stated objects of the invention are alternative and exemplary objects only, and no one or any should be read as required for the practice of the invention, or as an exhaustive listing of objects accomplished.

As suggested by the foregoing discussion, an exemplary and non-exclusive alternative object of this invention is to provide a portable and repositionable basketball goal.

A further exemplary and non-exclusive alternative object of the invention is to provide a basketball goal that can be stored or transported in a trunk or similar sized area.

A further exemplary and non-exclusive alternative object of the invention is to provide a basketball goal that uses a chain link fence as its support structure.

A further exemplary and non-exclusive alternative object of the invention is to provide a latch system for a basketball goal that resists disengagement or loosening.

A further exemplary and non-exclusive alternative object of the invention is to provide a tool for such a referenced latch system to ease attachment and reduce the potential for injury.

The above objects and advantages are neither exhaustive nor individual critical to the spirit and practice of the invention, except as stated in the claims as issued. Other alternative objects and advantages of the present invention will become apparent to those skilled in the art from the following description of the invention.

BRIEF DESCRIPTION OF THE DRAWINGS

FIG. 9(A and B) shows the backboard and hoop from a side view, to show the movement of the hoop for transport and the ability to lock it in place for play.

DETAILED DESCRIPTION OF THE INVENTION

The following is a detailed exemplary description of an embodiment of the invention, in a number of its various aspects. Those skilled in the art will understand that the specificity provided herein is intended for illustrative purposes with respect to an exemplary embodiment, only, and is not to be interpreted as limiting the scope of the invention or claims.

Figure 1:
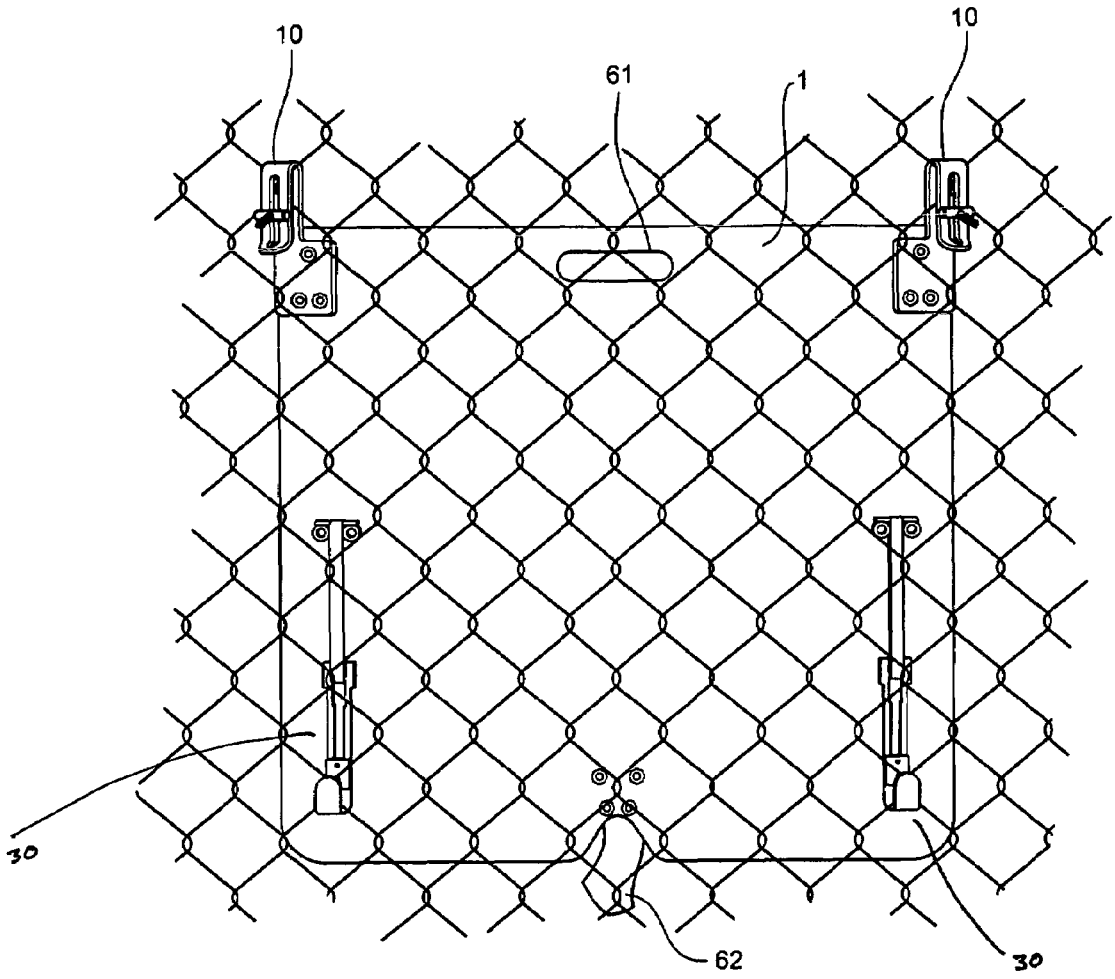
FIG. 1 shows a rear view of a basketball goal attached to a fence in accordance with the present invention.

Turning, now to the drawings, FIG. 1 shows the rear side of a backboard in an embodiment of the present invention, attached to a chain link fence as a support. As will be appreciated in the industry, the chain link fence is not a portion of the invention, but is a readily accessible support that may be found at virtually any location such as school public lots, training grounds, etc., where the invention may be set up for use. Use of such a ready support eliminates the need for users to carry a bulk pole and base.

On the rear of backboard 1 at the upper corners are latches 10. As may be seen from the figure, latches 10 hook over the connection point among 4 diamonds in the chain link fence. The backboard 1 is further secured to the fence against undesired movement by means of lower racks 30, shown here attached in the lower half of the backboard 1, and adjacent to the sides thereof. Strap 62, which will be described in greater detail further below, appears in this figure as it would in a complete unlocked assembly, depending from the approximate location of the goal.

Figure 2:
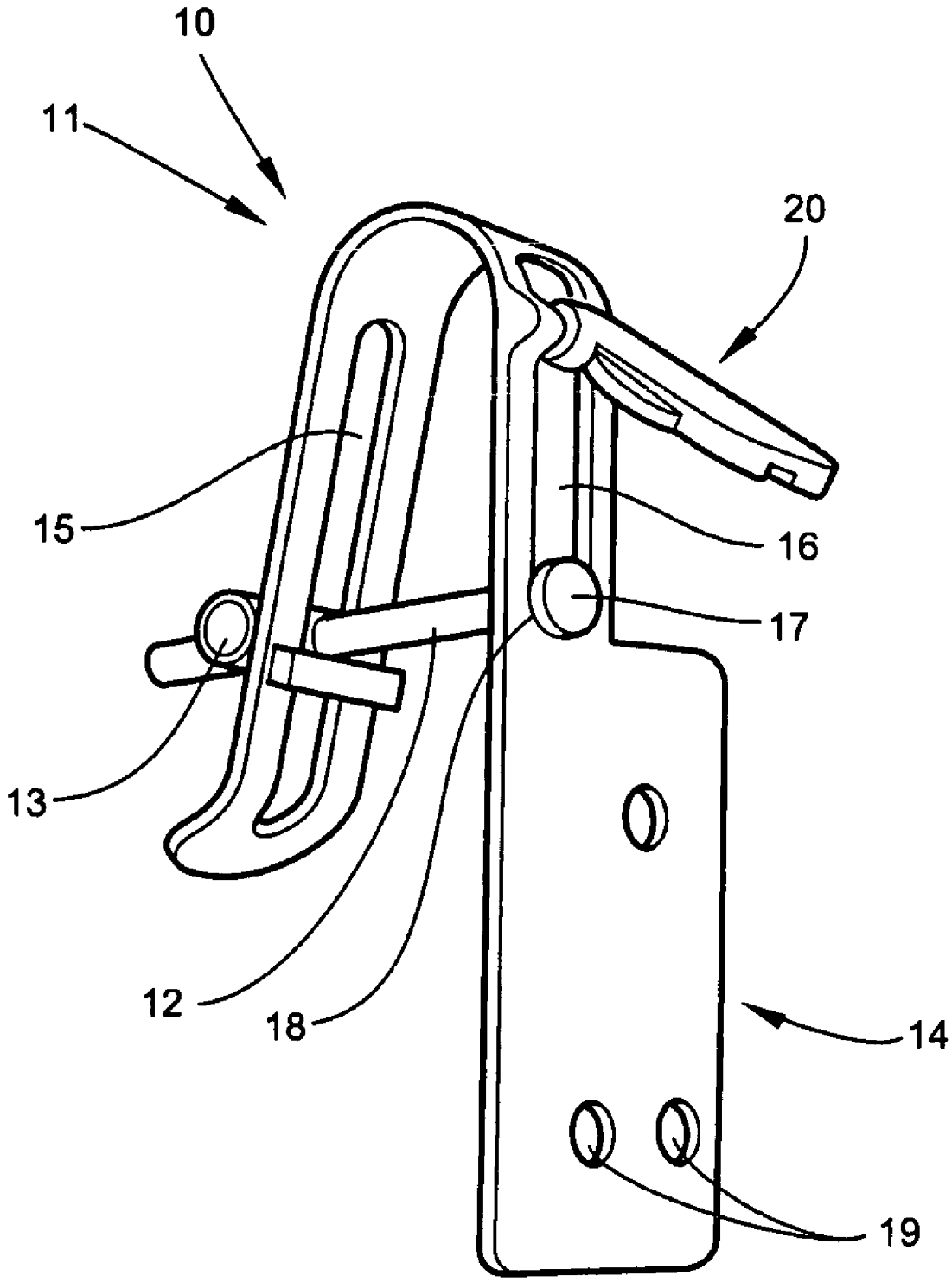
FIG. 2 shows an exemplary embodiment of the latch system of the present invention in which the locking bar is shown the closed position (locking the latch).

Latches 10 can be seen with greater detail in FIG. 2. As shown in FIG. 2, latch 10 includes a latch body 11 shaped in a generally hook fashion. As shown in the figure, the hook is large enough to accommodate the connection point of the diamonds of a chain link fence within the crook of the hook, shown in the figure at the top of the drawing. To one side of the crook is a latch side having a mounting plate 14, with mounting holes 19 bored therethrough for attachment to the rear of the backboard 1. In the figure, mounting plate 14 is shown to the right of the drawing. Above mounting plate 14 in assembly, and between mounting point 14 and the crook of the latch, is a lock groove 16, sized to allow the passage of a lock head 17 therethrough. The opposite side of latch 10 is characterized in the shown embodiment by an arm having a hinge groove 15 therethrough. Lock arm hinge 13 is attached to either side of the hinge groove and operates as an axle or pivot hinge for locking arm 12.

Figure 3:
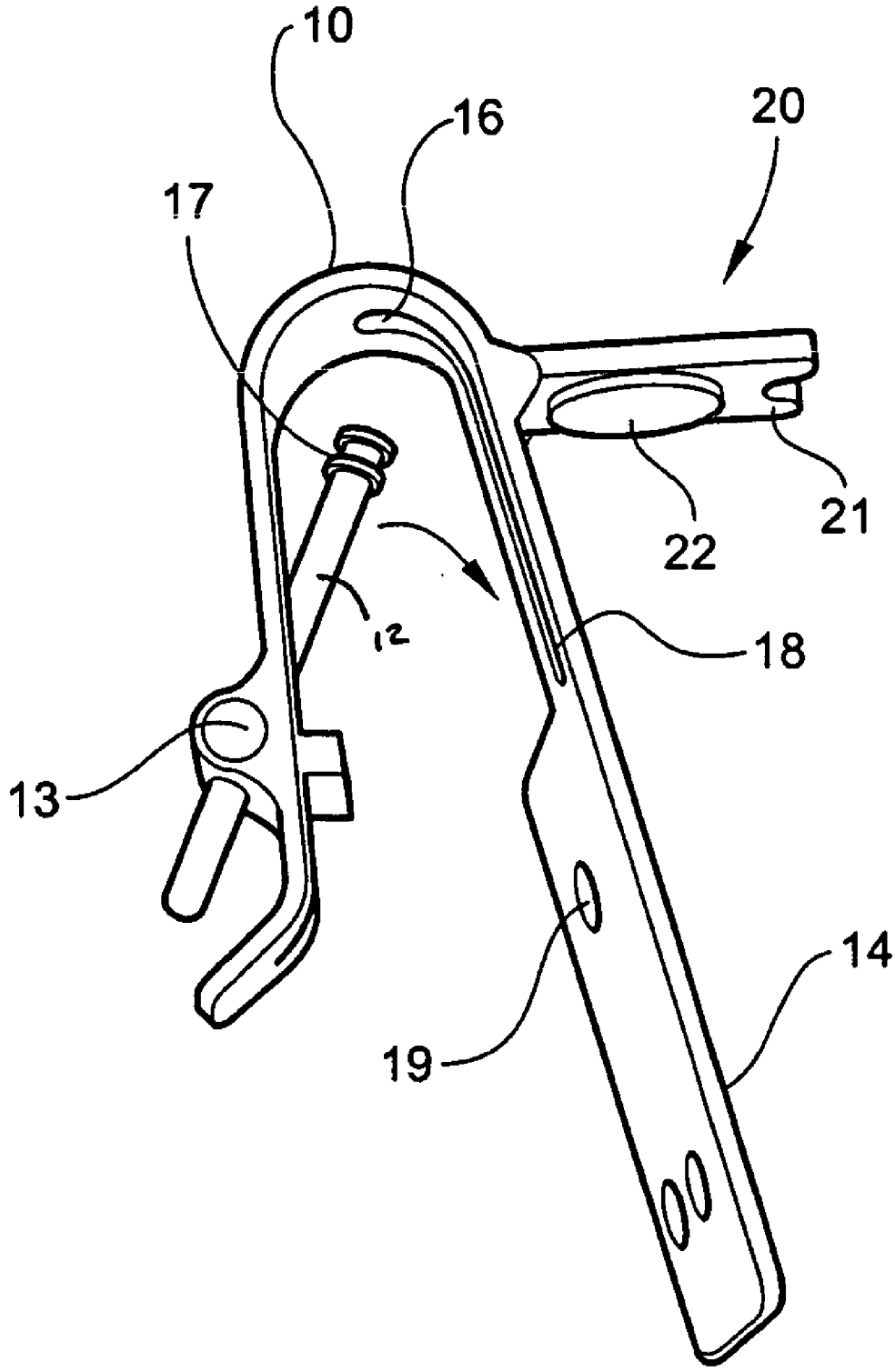
FIG. 3 shows a side view of a latch, in which the locking bar is show in an open position, wherein it can swing down and into locking position.

Locking arm 12 is a bar of sufficient length to pass through both hinge groove 15 and lock groove 16 on the opposite side of latch 10. The end of locking arm 12 opposite the lock arm hinge 13 is characterized by a lock head 17 which possesses an "H" cross-sectional view. In operation, locking arm 12 pivots about lock arm hinge 13 with a freedom of movement allowed by its passage through portions of hinge groove 15 and lock grove 16. In assembly, the arm of latch 10 having lock arm hinge 13 is place through the diamond of a chain link fence until the connection point of the diamonds rests adjacent the crook at the top of latch 10. It will be apparent to those in the art that to complete this insertion, locking arm 12 must be pivoted out of the way of the connection point to allow its movement into the upper portion of latch 10. In order to prevent dislodgment of latch 10 from the chain link fence, locking arm 12 is subsequently swung downward towards a position in which it will cross both arms of the latch. Lock head 17 possesses a width smaller than the widest passage in lock groove 16. Accordingly, lock head 17 may be inserted in line with lock groove 16 and slid downward until the crossbars of the H configuration settle on either side of the metal that borders lock groove 16. The operation of locking arm 12 and its H configuration of lock head 17 can be more clearly seen in FIG. 3.

In order to prevent lock head 17 from disengaging the locking portion of latch 10, the latch is provided with a gate 20, hinged above the location at which lock head 17 optimally rests. Looking to FIG. 3, gate 20 comprises a gate bar 21 with a lower configuration capable of mating securely with lock head 17. Gate 20 further includes a magnet 22 which ensures that 20 will not freely swing open and release lock head 17 without intentional exertion of force. As will be understood in operation, the swinging of lock arm 12 from the position shown in FIG. 3 down toward locking engagement with the mounting-side arm of latch 10 will prevent lock arm 12 from moving right or left as shown in the figures by virtue of the H configuration of lock head 17. Vertical movement of lock head 17 is prohibited by the closing of gate 20 and is secured in place by the magnetic connection between gate 20's magnet 22 and the body of latch 10.

It should be noted at this point that lock arm 12 and hinge 13 need not be secured in rigid arrangement. In fact, the inventor prefers in some embodiments that locking arm 12 be configured with respect hinge 13 such that locking arm 12 can slide up and down its length against lock arm hinge 13. This may be accomplished by constructing the axle of lock arm hinge 13 with a passage therethrough of complimentary configuration to the cross-section of locking arm 12. In such configuration, locking arm 12 could be slid in and out of lock arm hinge 13 between its terminus at lock head 17, and a protrusion, such as a cotter pin, on the opposite end of locking arm 12 that would prevent in total disengagement of lock arm 12 from the hinge 13.

Figure 4:
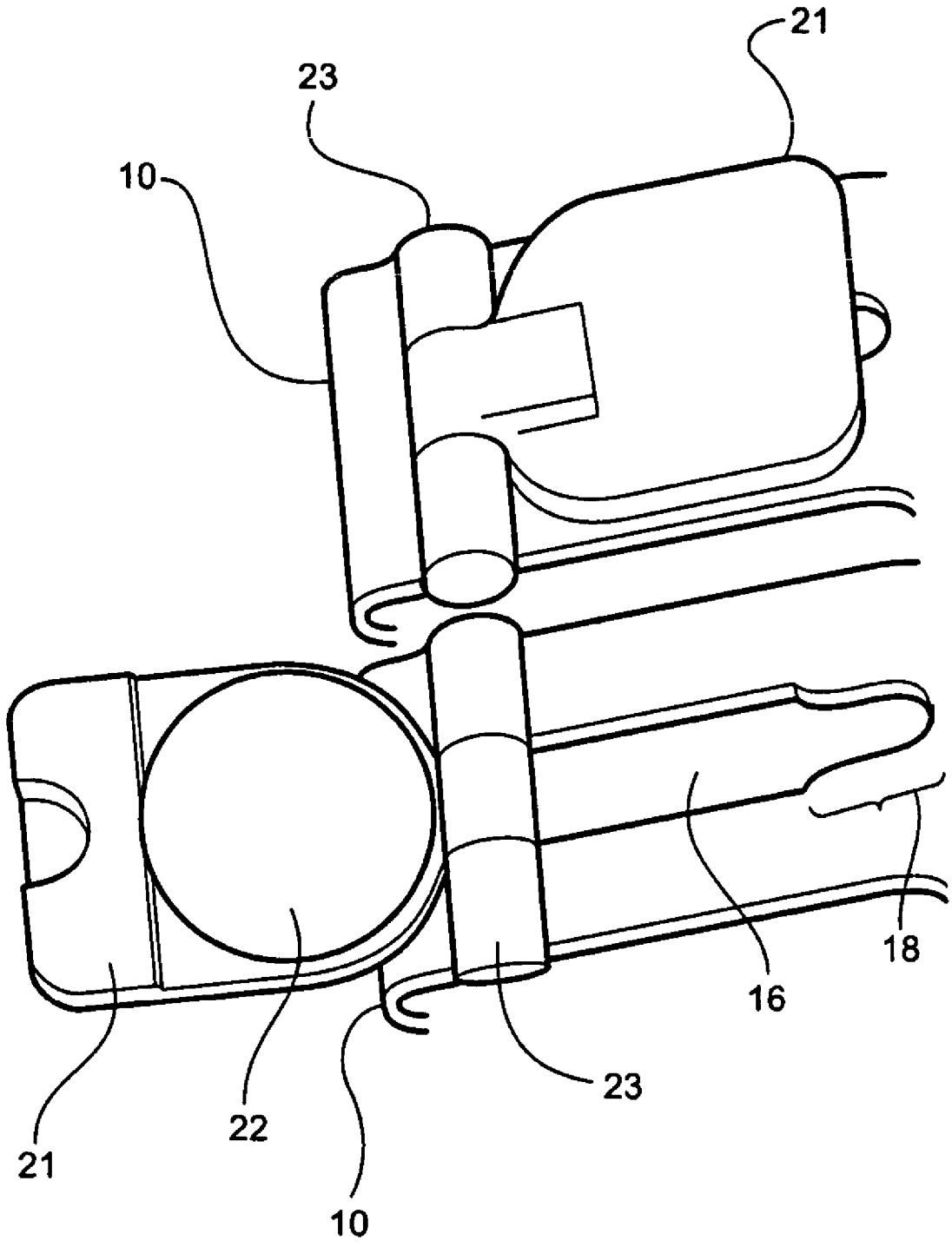
FIG. 4 shows the locking gate in two side-by-side positions for comparison, one in which the locking gate is open, showing the magnet and the relationship that allows for insertion of the locking arm, and the other in which the locking gate is closed.

Turning to FIG. 4, gate 20 is shown in greater detail, as is the lower portion of lock groove 16. FIG. 4 shows both latches 10 adjacent one another for ready comparison for the gates in open and closed position. As seen from FIG. 4, lock groove 16 narrows at its lower end into a lock neck 18. At its narrowest point in lock neck 18, the lock groove 16 possesses a width at least as great as the "cross-bar" of the H configuration of lock head 17, but less than the width of the widest point of remaining portions of lock head 17. As seen from comparison of the latches 10 in the open and closed state shown in FIG. 4, in the open state of gate 20, lock head 17 would be free to slide into and out of and along the length of lock groove 16, except at the position of lock neck 18. When in the position of lock neck 18, lock arm 12 would be unable to move other than along the length of the groove. To complete the securement of lock head 17, and therefore locking arm 12, gate 20 is lowered into the locked position, which ultimately prevents movement along the line of lock groove 16. By this mechanism, lock arm 12 and the lock head 17 are secured against all but intentional movement. When so fashioned onto a chain link fence, the top of backboard 1 is thus secured against the rigors of play.

Figure 5:
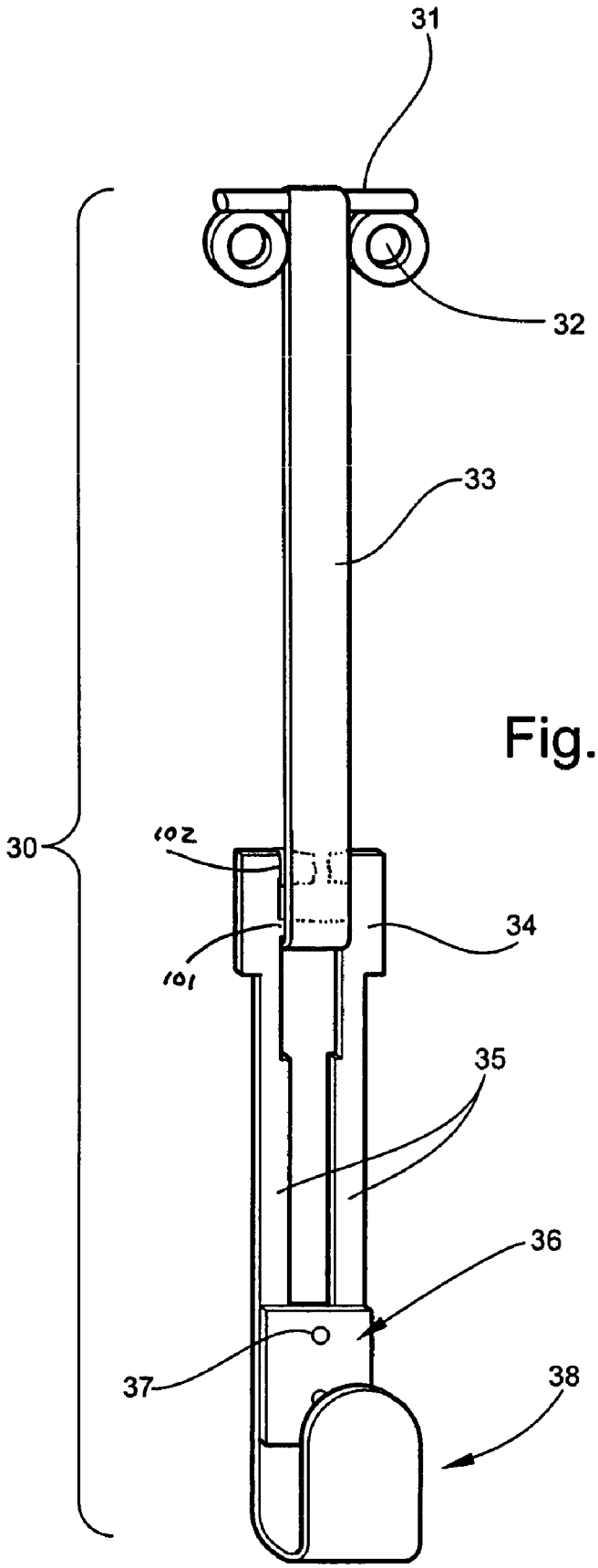
FIG. 5 shows a diagram of a lower attachment for further securing the backboard to a fence.

Turning now to FIG. 5, once the upper latches of backboard 1 are secured to the chain link fence, the bottom of the backboard is secured against movement by means of lower racks 30. Lower racks 30 are in the shown embodiment resiliently extendible members in which the hook bends 38 at the lower terminus are capable of being pulled down without tools and by only finger and/or thumb force. In construction, lower rack 30 includes a band anchor 31, secured to backboard 1 by anchor bolts 32. Band anchor 31 possesses a crossbar for attachment to a resilient member, shown here as a strong band 33. The inventor notes that band 33 exhibits excellent results when constructed of the same material as inner tube size 12. Hook bend 38 is attached to band 33 by a set of hook rails 35 connected at one end by a solid stabilizer bar in the area of 101 (and underneath the band as shown) that both spans the gap between hook rails 35 and provides support for the band 33 and rigidly (as shown) connects the hook rails 35. At the opposite end the hook rails are connected rigidly by hook bend 38. Above the stabilizer bar (as shown), and separated therefrom by a gap sufficient for a portion of the band to fit through, is a loading bar (see the area of 102, the loading bar being hidden from view by the fact that the band 33 overlaps it) that extends into the area between hook rails 35 and has along its length a gap through which the bad 33 can pass for purposes of assembling the device. In assembly, the band 33 is slipped through the gap in the loading bar (typically, by twisting it sideways) and positioned so that it laps over both sides of the loading bar and the gap therein between the band 33 is then brought down past the stabilizer bar from behind and then folded up and over the stabilizer bar (thus substantially hiding it from sight in the figures). It is pulled up past the loading bar (thereby overlapping itself) and up toward the position for band anchor 31. Band anchor 31 is passed through band 33 and then affixed to backboard 1. Thus the band 33 is fixed at its top by having band anchor 31 pass through it. The band 33 then is a resiliently extendible and tensionable member that allows hook bend 38 to be pulled downward and hooked under a link of fence, whereupon when the downward pulling force is released, the band 33 draws hook bend 38 upward and into secure engagement with the link of fence. Because the upper hooks are oppositely facing of hook bend 38, and are positioned to rest over a link of fence with the hook facing down, the entire structure "squeezes" together on the fence, ensuring that the backboard 1 does not jostle free. As will be understood from this FIG. 5, due to the resilient nature of band 33, and the static connection of band anchor 31 to backboard 1 by means of anchor bolts 32, pulling downward on hook bend 38 will stretch band 33 while causing increasing return pressure tending to draw the hook bend 38 back upwards. To ensure consistent connection and firm securement of hook bend 38 into the diamond connections of a chain link fence, hook bend 38 is prohibited from rising off of backboard 1 by means of a hook track 36. Hook track 36 is bolted onto backboard 1 by hook track bolts 37. As will be understood from its connectivity to hook rails 35, hook track 36 is raised off of backboard 1 by a distance sufficient to allow clearance of the hook rails 35 thereunder. The width of hook track 36 is such that the sides of hook track 36 overlap the hook rails 35. Accordingly, hook rails 35 and consequently hook bend 38, may slide along the length of the gap between hook rails 35 but not away from backboard 1. Thus, to complete assembly, hook bends 38 are pulled downward by hand pressure until they reach within the diamond of a chain link fence with sufficient upward force of band 33 to secure the hook bends 38 from unintentional dislodgment.

Figure 6:
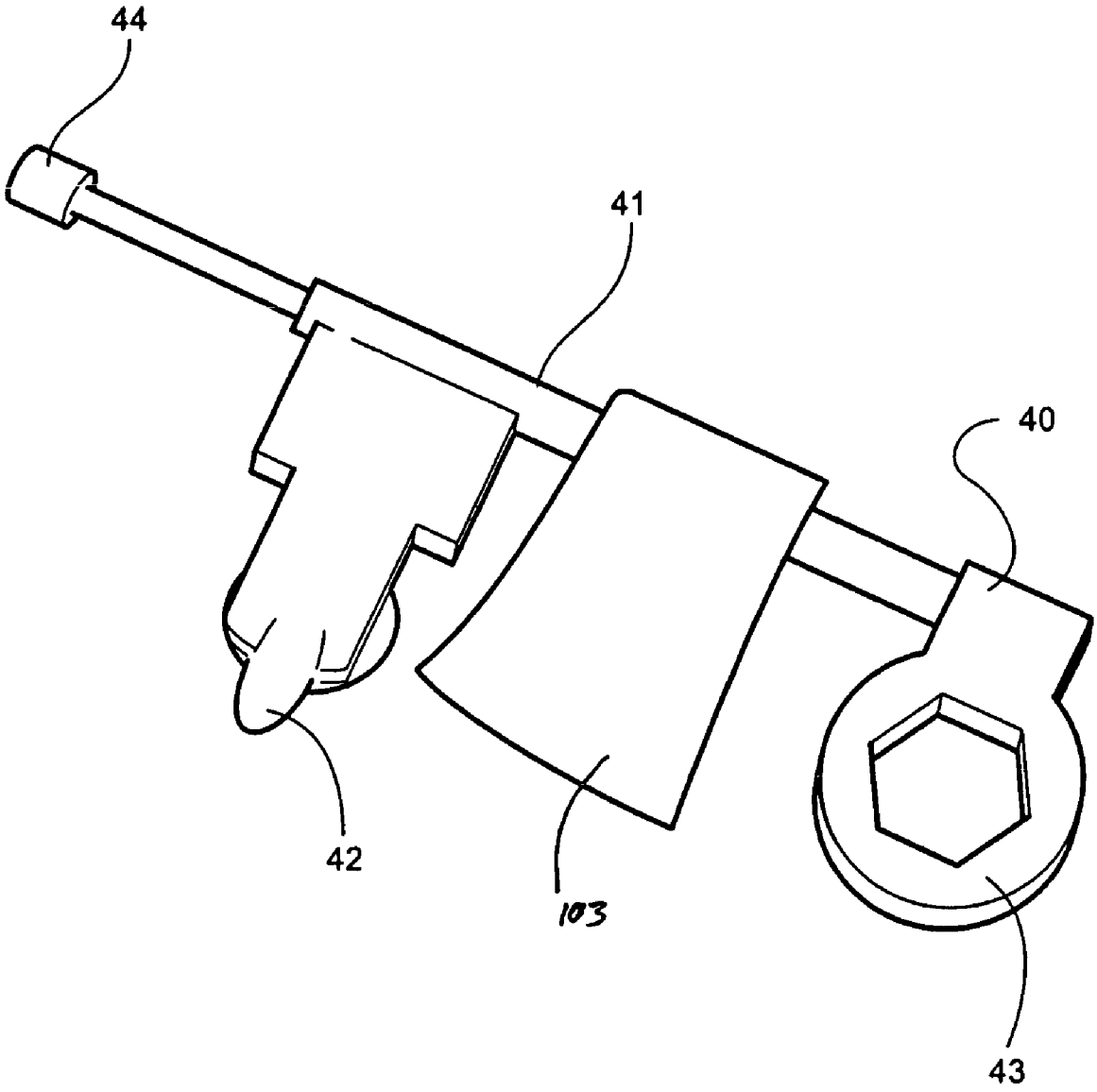
FIG. 6 shows an embodiment of a tool for locking the latch system and overall assembly of screws and bolts.
Figure 7:
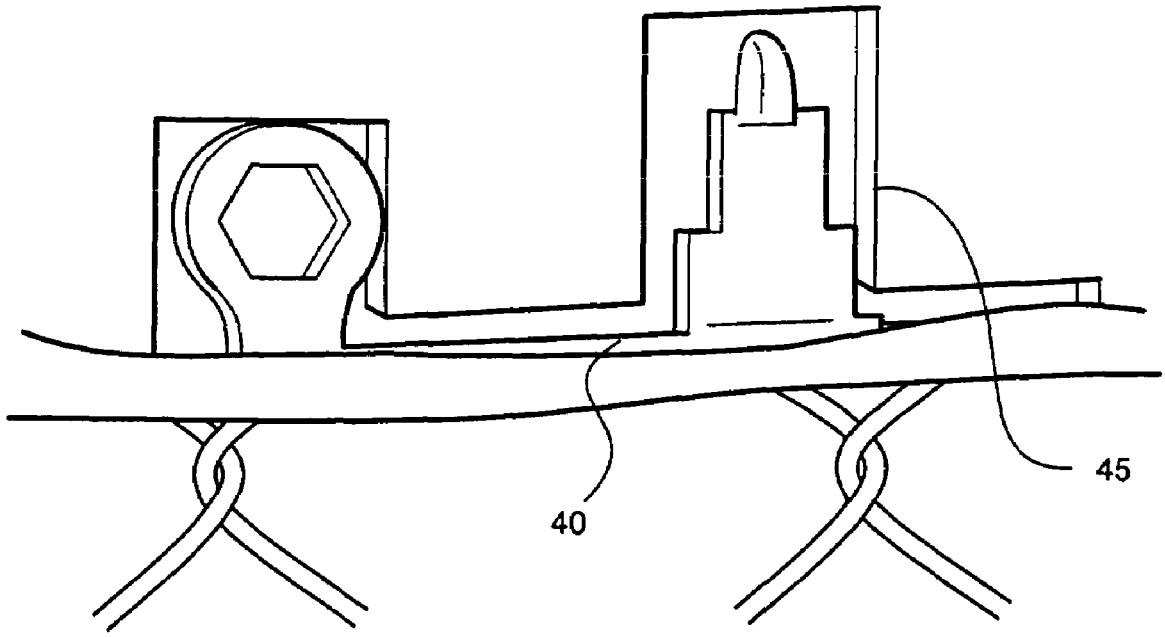
FIG. 7 shows the tool in place in a holding area in the front of the backboard (shown with the holding area in the bottom of the front of the backboard).

In a further embodiment and aspect of the invention, the lock head 17 of locking arm 12 may be constructed of a material attractive to a magnet. For ease of assembly and safety reasons, particularly where locking arm 12 is allowed to slide against locking arm hinge 13, the inventor contemplates a specialty tool with a magnetic retriever head 44, as shown in FIG. 6. Tool 40 as shown in this figure possesses an extendable arm with a magnet 44 at one end for passage through the lock groove 16 of latch 10 to grab lock head 17 and pull it through to the desired locking location in the groove. Along shaft 41, tool 40 optionally may also include tool bits such as screw head 42 and bolt grip 43. In this manner, tool 40 may be simply provided with all of the tools necessary to completely assemble or disassemble a backboard of the present invention and secure the same to a fence. It will be understood by those in the art that the tools are not limited to screw 42 and bolt 43 but that also could be provided hex keys and other tool embodiments. As shown in FIG. 7, backboard 1 may be provided with an inset 45 configured to allow stowage of the tool 40, rendering the embodiment completely self-enclosed.

Figure 8:
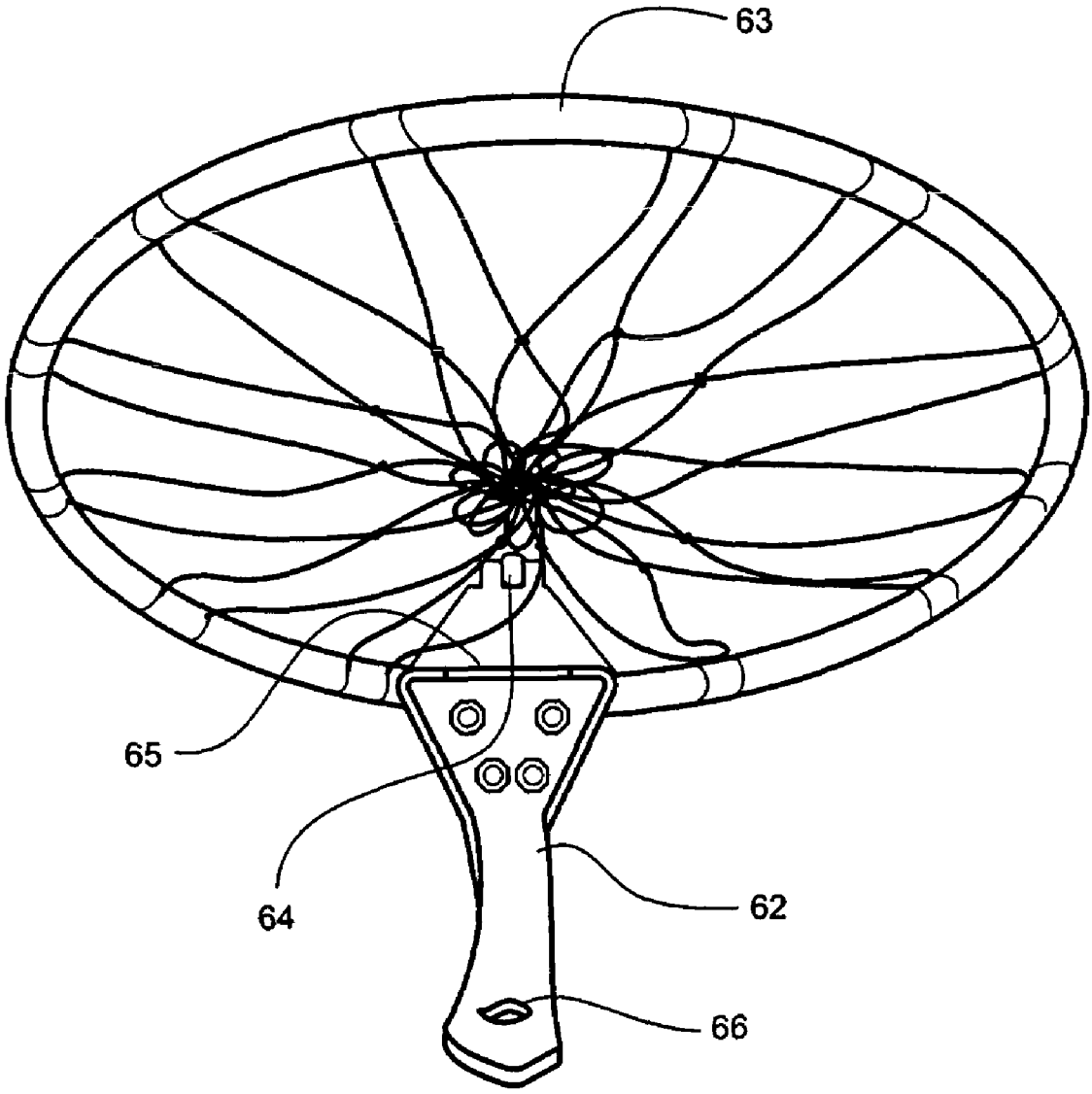
FIG. 8 shows an embodiment of the hoop (with the net tied up in the middle for easy visibility, it being understood that the net would swing free during play).

Turning to the front of the portable goal assembly, FIGS. 8, 9A, and 9B show an embodiment for a hoop 63 for the present invention, with locking strap 62. To allow for easy portability of backboard 1 with hoop 63 in place, while reducing the stored profile of the embodiment of the whole, hoop 63 is connected to backboard 1 by means of hoop hinge 65. One half of hoop hinge 65 (the hinge plate 202) is secured to backboard 1 by conventional means, such as nuts and bolts 201. The other swingable end of hoop hinge 65 (the hoop plate 203) is configured to swing with respect to hinge plate 202 such that it can range from a flat relation to hinge plate 202 all the way through a perpendicular position relative thereto. The hoop 63 is positioned perpendicular to hoop plate 203 (thus it will be seen that when hinge plate 202 and hoop plate 203 are in flat abutment, hoop 63 will be perpendicular to hinge plate 202; likewise, since hinge plate 202 is flat to backboard 1, in such position hoop 63 will be perpendicular to backboard 1 and ready for play. As will be understood, hoop hinge 65 allows hoop 63 to fold upward and flat against backboard 1 (which will render hoop plate perpendicular to backboard 1). A locking strap 62 is secured between the hoop 63 and backboard 1 in such a manner as to create tension urging the hinge and lock mechanism into a locking position for transportation. To secure the assembly in this position for transport, the hoop hinge 65 may have a swingable and tightenable extender knob 14. When hoop 63 is extended perpendicular to backboard 1 (e.g., in game play position), as shown in FIG. 9A this places extender knob 14 adjacent to hinge plate 202, but connected to hoop plate 203. When so positioned, extender knob 14 can be swung about know hinge 204 so that it extends beyond the back of the hinge plate 202 and overlaps a portion thereof. Extender knob 14 can then be tightened or fixed so that it cannot swing free, meaning that the hoop 63 cannot swing away from perpendicular relative to the backboard 1. See FIG. 9A. FIG. 9B shows the hoop 63 in transition toward storing/transport position (hook 63 against backboard 1). When in play, extender knob 14 is obviously in fixed position. When in transport position, however, the extender knob 14 may be free swinging on knob hinge 204. To secure the extender knob 14 for safety or other reasons, strap 62 may be provided. Strap 62 is fixed between hinge plate 202 and backboard 1, and may be passed over extender knob 14, to press it toward backboard 1. The opposite end of strap 62 has a strap keyhole 66 that can fit over the knob hinge 204, thereby creating a 'casing' or securement area for extender knob 14 to keep it from freely swinging. The tension imparted by strap 62 does not force hoop 63 back into playing position Hoop 63 is secured at its other side to the backboard 1, such as by strap or clasp running through hoop 63 and into or about handle 61.

Alternatively, for ease of disassembly and stowage, locking strap 62 may be provided with mechanisms to increase or decrease the tension, in one embodiment, with decreased tension being desirable for storage. In one embodiment, locking strap 62 is secured between hoop 63 and backboard 1 with sufficient play to allow full folding of hoop 63 flat against backboard 1. When play of game is desired, the tension is increased by inserting an extender knob 64 or other material in between the locking strap 62 and backboard 1, thus increasing the tension and locking the strap in a hoop-down position. In an alternate embodiment, locking strap 62 is sandwiched between the front of backboard and bottom of the bolted rim plate (see FIG. 1) and have a mechanism for attachment or disattachment from a portion of the hoop 63 at the end, such as strap keyhole 66, which would mate with a protrusion on hoop 63. By means of attaching such strap keyhole 66 over the protrusion, the resilient locking strap 62 would be brought into a tensioned state so that the hinge know can no longer swing freely (for example, to prevent injury).

Variance to the tensionable member in locking embodiments will be apparent to those in the industry, and may be substituted for locking and disengaging locking of hoop 63 into playing and non-playing storage positions. In one embodiment of this invention, the entirety of backboard and hoop may be stowed flat in such space that multiple items could be carried by a single person and stored in a single trunk. Further, portability may be rendered more ready by the addition of such features as a handle 61 in a location on the backboard.

Particular embodiments of the invention may include additional features as may be driven by advantage and specific application. By way of example, the inventor has in several embodiments included hook-and-loop fastening material as a finisher in various manners. Among the applications for such material, the inventor has used the material to round out and enhance the safety features and safe transportation of the device. The rim in its transport position may be configured to rest upon a hook-and-loop (such as Velcro™) plate that serves as a cushion between metal rim and wooden backboard surface. The cushion may have sufficient length to wrap around the rim and a portion of the back board 1 by going through the hand groove and completing the securing of top portion of the rim. Additionally, such material can include an extending flap that wraps around the rim and fastens to the hand groove 61 so the rim may be further secured against free fall, unintended opening, and looseness. In yet another application of hook-and-loop or similar reattachable material, material is added in the area of the upper hooks. Two patches of the material may be fixed to the front part of the backboard as fasten points for tightly fitting cotton pouches that serve as protectors and mechanisms to lock-in the otherwise free moving locking arm 12. The tool, likewise, may be made to take advantage of reattachable material or configurations, by placing the same in a close fitting groove in the front of board, smoothed over and enclosed in a rectangular shape hook-and-loop casing. Likewise as shown in FIG. 6, the tool may have a hook-and-loop dangle attached as shown by dangle 103. Accessories may be attached to the backside of the board with an optional pouch. Such accessories may include extra bands, rim fasteners, adhesive protective patches, and net fasteners.

A cotton-padded shoulder bag may be provided for storage and transportation. Such a bag would give added protection during storage and transport, which may assist avoiding damage to the slightly protruding hooks and rim parts. Due to the size and configuration of the goal and backboard, the bag may obtain advantage by possessing both a shoulder strap and a separate hand grip for convenient handling. The bag may also include a compartment where accessories and replacement parts can be placed.

In one embodiment, the net is fastened to the rim by 12 tightly fitting plastic handcuffs. Over these a cover comprising relatively thick adhesive cotton patches, which are long enough to provide additional support for the net, may be placed for additional securing. The two may be wrapped in adhesive tape which makes for a smooth finish.

The ready portability of the device of the present invention, together with its repositionable securement, makes the invention ideal for all manner of teaching and development of basketball skills. The device of the present invention may be placed in a location on a chain-link fence remote from posts, which would allow for a "softer" response of the backboard. An advantage of such a soft mounting, or a "giving" mounting is that shots rebounding from the backboard are much more likely to sink into the goal, meaning that confidence and skill may be developed gradually, in tandem.

In a developmental and teaching aspect, the device is geared to assist every beginner to the sport of basketball. The basket allows those who are trying to develop or master the necessary skills of shooting to do so with proper body posture and technique. The device is adjustable from hour to hour to fit the needs of the smallest participant, and the largest participant, alike. When two baskets are placed close together in the corner angles of a fencing area, the running distance can be reduced to the point, where passing and shooting are the focus points of development.

In an aspect focused on use in competition, the device may make large scale competitions easy and possible. Numerous baskets can be placed along a fence, with 10-15 players to a basket. A variety of shooting contests can take place without the young participants putting unhealthy stress on ankles, knees and backs in their developing years. A proper set-up of one basket can easily keep 15-20 children busy and having fun all the while. Any coach, PE teacher, or scout master may paint in a shooting gallery, remembering the range of our targeted age groups (6-10 yr.), and may create a ½ point shooting range and then 1,2, and 3, point ranges In a Professional aspect of the device, camps may be arranged to use the invention in an integrated program approach, provided that sufficient staff is called to provide an exhaustive program of Basketball. With relatively little investment of space and funds, six baskets on the inside surface of a fence may be arranged to support play of three simultaneous games, six sessions of shooting, one-on-one, two-on-two, three-on-three, etc. At the same time, baskets can be put on the outside fence surface for free-throw shooting or other warm up exercises. In the context of a multi-basket configuration, all participants will have a higher rate of ball contact, which adds to an intensity that is also a product of the multi-basket program.

In a Recreational aspect, because the basket may be freely movable among parks and playground sites, a player, coach, or family always is able to readily find a game or practice area, ensuring greater ball-time and thus greater skill development. Intramural programs could also profit from the multi basket set up.

In advantageous consideration of the invention, the device is particularly useful for training the 6 to 10 year-old age group. Firstly, the basket's adaptability which enables the basket to be adjusted in the shortest amount of time to suit the variety of age groups and levels of development it will face. One of the original intentions of the basket was to put the basket at a range where proper shooting posture could be maintained. With the invention, this is possible and any elevation is done when the strength of the pupils dictate it is safe to do so. Secondly, the variety of shooting games may be geared at keeping a high number of children busy and enthusiastic. These shooting games have the under developed body of children at heart. The games may require that the children take the "both feet parallel stance", whereby the back has an upright posture and allows the quadriceps muscle to do the minimal work required to get the close range shot off. Presently, No official provision has been made for the lay-up in the 6-10 yr. olds development. The invention may be used to provide one great advantage, wherein the mechanics of a lay-up could be carried out without the pupil leaving the ground.

Concluding Remarks

The foregoing represents certain exemplary embodiments of the invention selected to teach the principles and practice of the invention generally to those in the art so that they may use their standard skill in the art to make these embodiments or other and variable embodiments of the claimed invention, based on industry skill, while remaining within the scope and practice of the invention, as well as the inventive teaching of this disclosure. The inventor stresses that the invention has numerous particular embodiments, the scope of which shall not be restricted further than the claims as issued. Unless otherwise specifically stated, applicant does not by consistent use of any term in the detailed description in connection with an illustrative embodiment intend to limit the meaning of that term to a particular meaning more narrow than that understood for the term generally.

I claim:

1. A transportable basketball backboard, comprising a. A backboard;

b. A hoop attached to the backboard by a hinge;

c. An upper hook protruding from the backboard in a direction opposite of the hoop; said upper hook comprising i. a latch body generally in the form of a hook for engaging a portion of a support structure, ii. a locking arm connected to the latch body and positionable between a first, open position in which the hook of the latch body is open and a second, closed position in which the hook of the latch body is closed by the locking arm, and iii. a magnet positioned to resist movement of the gate from the closed position, and d. A lower hook attached to the backboard by a resiliently extendible member.

2. A transportable basketball backboard, comprising a. A backboard;

b. A hoop attached to the backboard by a hinge;

c. An upper hook protruding from the backboard in a direction opposite of the hoop; said upper hook comprising i. a latch body generally in the form of a hook for engaging a portion of a support structure, ii. a locking arm connected to the latch body by a hinge and positionable between a first, open position in which the hook of the latch body is open and a second, closed position in which the hook of the latch body is closed by the locking arm, and d. A lower hook attached to the backboard by a resiliently extendible member, in which the locking arm, in addition to being swingably connected to the latch body by the hinge, is slidably connected to the latch body, whereby an end of the locking arm is capable of both translational and arcuate movement in at least two dimensions.

3. A transportable basketball backboard, comprising a. A backboard;

b. A hoop attached to the backboard by a hinge;

c. An upper hook protruding from the backboard in a direction opposite of the hoop; said upper hook comprising i. a latch body generally in the form of a hook for engaging a portion of a support structure, ii. a locking arm connected to the latch body and positionable between a first, open position in which the hook of the latch body is open and a second, closed position in which the hook of the latch body is closed by the locking arm, and d. A lower hook attached to the backboard by a resiliently extendible member, wherein the lower hook further comprises a hook track fixedly attached to the backboard, and a hook rail connected to the hook track in a manner that the hook rail may slide relative to the hook track.

* * * * *